US010872568B2

(12) United States Patent
Yuan et al.

(10) Patent No.: US 10,872,568 B2
(45) Date of Patent: Dec. 22, 2020

(54) PIXEL CIRCUIT, DRIVING METHOD THEREOF AND DISPLAY DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Zhidong Yuan, Beijing (CN); Yongqian Li, Beijing (CN); Meng Li, Beijing (CN); Can Yuan, Beijing (CN); Haixia Xu, Beijing (CN); Jun Wang, Beijing (CN); Xuehuan Feng, Beijing (CN)

(73) Assignees: HEFIE XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/444,011

(22) Filed: Jun. 18, 2019

(65) Prior Publication Data

US 2020/0135109 A1 Apr. 30, 2020

(30) Foreign Application Priority Data

Oct. 31, 2018 (CN) ..... 2018 1 1289833

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2300/043* (2013.01); *G09G 2300/0426* (2013.01)

(58) Field of Classification Search
CPC .. G09G 3/3258; G09G 3/3266; G09G 3/3291; G09G 2300/0426;
(Continued)

(56) References Cited

U.S. PATENT DOCUMENTS

2014/0368706 A1* 12/2014 Park ..... H04N 5/37457 348/301
2015/0145902 A1* 5/2015 Nakayama ..... G09G 3/3266 345/691
(Continued)

FOREIGN PATENT DOCUMENTS

CN 107452334 A 12/2017
CN 107657923 A 2/2018
(Continued)

OTHER PUBLICATIONS

First Office Action for Chinese Patent Application No. 2018112898339 dated Nov. 20, 2019.

*Primary Examiner* — Brent D Castiaux
(74) *Attorney, Agent, or Firm* — Calfee, Halter & Griswold LLP

(57) ABSTRACT

A pixel circuit, a driving method and a display device. The pixel circuit includes a light emitting unit; a drive transistor configured to drive the light emitting unit to emit light to display an image frame; and a control circuit configured to control the drive transistor according to signals on control lines. The method of controlling includes: resetting, in a reset stage of an image frame, a voltage of the first electrode of the drive transistor by applying a reset voltage, and sensing, in a sense stage, a threshold voltage of the drive transistor by applying a reference voltage. The control circuit is further configured to control, in an offset elimination stage at the beginning of the image frame and prior to
(Continued)

the reset stage, the drive transistor to be switched off, which was in an ON state at the end of a previous image frame.

17 Claims, 3 Drawing Sheets

(58) Field of Classification Search
CPC ..... G09G 2300/043; G09G 3/3233; G09G 2310/061; G09G 2320/0295
See application file for complete search history.

(56) References Cited

U.S. PATENT DOCUMENTS

| | | | | |
|---|---|---|---|---|
| 2015/0379940 | A1* | 12/2015 | Kishi ..... | G09G 3/3291 345/690 |
| 2017/0132980 | A1* | 5/2017 | Wu ..... | G09G 3/3233 |
| 2019/0096322 | A1 | 3/2019 | Gao | |
| 2019/0147797 | A1 | 5/2019 | Yuan et al. | |

FOREIGN PATENT DOCUMENTS

| | | | |
|---|---|---|---|
| CN | 107767819 | A | 3/2018 |
| CN | 207134126 | U | 3/2018 |
| CN | 108806599 | A | 11/2018 |

* cited by examiner

PIXEL CIRCUIT, DRIVING METHOD THEREOF AND DISPLAY DEVICE

CROSS REFERENCE TO RELATED APPLICATIONS

This application claims the benefit of Chinese Patent Application No. 201811289833.9, filed on Oct. 31, 2018, the entire disclosure of which is incorporated herein by reference.

FIELD

This disclosure relates to the field of display technology, and in particular to a pixel circuit, a driving method thereof, and a display device.

BACKGROUND

In existing self-luminous display devices, especially in active-matrix organic light emitting diode (AMOLED) display devices, a displayed image is generally achieved by driving OLEDs to emit light. However, the current for driving the OLEDs to emit light needs to be provided by a drive transistor in a pixel circuit. For homogeneity of light emission of the display device, the characteristics of the drive transistors need to be consistent. Since drifts of a threshold voltage Vth of the drive transistor can cause inhomogeneity of the display brightness, it is necessary to eliminate the influence of the threshold voltage Vth by using a compensation method.

SUMMARY

According to a first aspect of exemplary embodiments, a pixel circuit is provided. The pixel circuit comprises a light emitting unit, a drive transistor and a control circuit. A first electrode of the drive transistor is connected to a first terminal of the light emitting unit. The drive transistor is configured to drive the light emitting unit to emit light so as to display an image frame. The control circuit is connected with a gate of the drive transistor and the first electrode of the drive transistor, and configured to control the drive transistor according to signals on control lines, comprising: resetting, in a reset stage of the image frame, a voltage of the first electrode of the drive transistor by applying a reset voltage, and sensing, in a sense stage, a threshold voltage of the drive transistor by applying a reference voltage. The control circuit is further configured to control, in an offset elimination stage arranged at the beginning of the image frame and prior to the reset stage, the drive transistor to be switched off, which drive transistor was in an ON state at the end of a previous image frame.

In some exemplary embodiments, a second electrode of the drive transistor is connected to a first voltage terminal. A second terminal of the light emitting unit is connected to a second voltage terminal. The control line comprises a first gate line, a second gate line, a data line and a sense line. The control circuit further comprises: a first transistor and a second transistor. A gate of the first transistor is connected to the first gate line, a first electrode of the first transistor is connected to the date line, a second electrode of the first transistor is connected to the gate of the drive transistor, and the first transistor is configured to be switched off under control of the first gate line in the offset elimination stage. A gate of the second transistor is connected to the second gate line, a first electrode of the second transistor is connected to the first electrode of the drive transistor, a second electrode of the second transistor is connected to the sense line, and the second transistor is configured to be switched on under control of the second gate line in the offset elimination stage such that the first electrode of the drive transistor conductively connects with the sense line and the voltage of the first electrode of the drive transistor is elevated by charging a parasitic capacitor of the sense line. The drive transistor is configured to be switched off in the offset elimination stage when the voltage of the first electrode of the drive transistor is elevated to a level that makes a gate-source voltage of the drive transistor smaller than the threshold voltage.

In some exemplary embodiments, the first transistor is further configured to be switched on under control of the first gate line in the reset stage to output the reference voltage on the data line to the gate of the drive transistor. The second transistor is further configured to be switched on under control of the second gate line in the reset stage to output the reset voltage on the sense line to the first electrode of the drive transistor. The reference voltage and the reset voltage are so set that the drive transistor is switched on.

In some exemplary embodiments, the first transistor is further configured to be switched on under control of the first gate line in the sense stage to output the reference voltage to the gate of the drive transistor. The second transistor is further configured to be switched off under control of the second gate line in the sense stage to elevate the voltage of the first electrode of the drive transistor from the reset voltage. The drive transistor is configured to be switched off in the sense stage when the voltage of the first electrode of the drive transistor is elevated to a level that makes the gate-source voltage of the drive transistor smaller than the threshold voltage.

In some exemplary embodiments, the pixel circuit further comprises a tank circuit. A first terminal of the tank circuit is connected to the gate of the drive transistor, and a second terminal of the tank circuit is connected to the first electrode of the drive transistor. The first transistor is configured to be switched on under control of the first gate line in a data-writing stage subsequent to the sense stage so as to store the data voltage of the data line in the tank circuit.

In some exemplary embodiments, the first transistor is configured to be switched off under control of the first gate line in a light emitting stage subsequent to the data-writing stage. The second transistor is configured to be switched off under control of the second gate line in the light emitting stage. The tank circuit is configured to discharge the gate of the drive transistor in the light emitting stage to keep the drive transistor switched on, so as to drive the light emitting unit to emit light.

In some exemplary embodiments, the light emitting unit is an organic light emitting diode.

In some exemplary embodiments, the first transistor is further configured to be switched on under control of the first gate line in the sense stage to output the reference voltage to the gate of the drive transistor. The second transistor is further configured to be switched off under control of the second gate line in the sense stage to elevate the voltage of the first electrode of the drive transistor from the reset voltage. The drive transistor is configured to be switched off in the sense stage when the voltage of the first electrode of the drive transistor is elevated to a level that makes the gate-source voltage of the drive transistor smaller than the threshold voltage.

According to a second aspect of the exemplary embodiments, a method for driving a pixel circuit is provided. The pixel circuit may be a pixel circuit according to the first aspect. The method comprises: resetting, in the reset stage, a voltage of the first electrode of the drive transistor by applying the reference voltage and the reset voltage, and sensing, in the sense stage, the threshold voltage of the drive transistor by applying the reference voltage. The method further comprises: controlling, in an offset elimination stage that is arranged at the beginning of an image frame and prior to the reset stage, the drive transistor to be switched off, which drive transistor was in an ON state at the end of a previous image frame.

In some exemplary embodiments, the method comprises in the offset elimination stage: inputting an OFF signal into the first gate line to control the first transistor to be switched off; inputting an ON signal into the second gate line to control the second transistor to be switched on such that the first electrode of the drive transistor conductively connects with the sense line and the voltage of the first electrode of the drive transistor is elevated by charging a parasitic capacitor of the sense line.

In some exemplary embodiments, the method comprises in the reset stage: inputting an ON signal into the first gate line and a reference voltage into the data line to switch on the first transistor and output the reference voltage to the gate of the drive transistor; inputting an ON signal into the second gate line and a reset voltage into the sense line to switch on the second transistor and output the reset voltage to the first electrode of the drive transistor. The method comprises in the sense stage: inputting an ON signal into the first gate line and a reference voltage into the data line to switch on the first transistor and output the reference voltage to the gate of the drive transistor; inputting an OFF signal into the second gate line to switch off the second transistor, so as to elevate the voltage of the first electrode of the drive transistor from the reset voltage. The drive transistor is switched off when the voltage of the first electrode of the drive transistor is elevated to a level that makes the gate-source voltage of the drive transistor smaller than the threshold voltage.

In some exemplary embodiments, after the sense stage, the method further comprises: in the data-writing stage, inputting an ON signal into the first gate line and a data voltage into the data line to switch on the first transistor and store the data voltage for a pixel in the tank circuit; and in the light emitting stage, inputting an OFF signal into the first gate line and the second gate line and continuously discharging the gate of the drive transistor by the tank circuit to keep the drive transistor switched on, so as to drive the light emitting unit to emit light.

According to a third aspect of the exemplary embodiments, a display device is further provided, which comprises a pixel circuit according to the first aspect.

BRIEF DESCRIPTION OF DRAWINGS

Now the above and other aspects of the present disclosure will be described in more detail with reference to drawings illustrating the exemplary embodiments.

DETAILED DESCRIPTION

Figure 1:
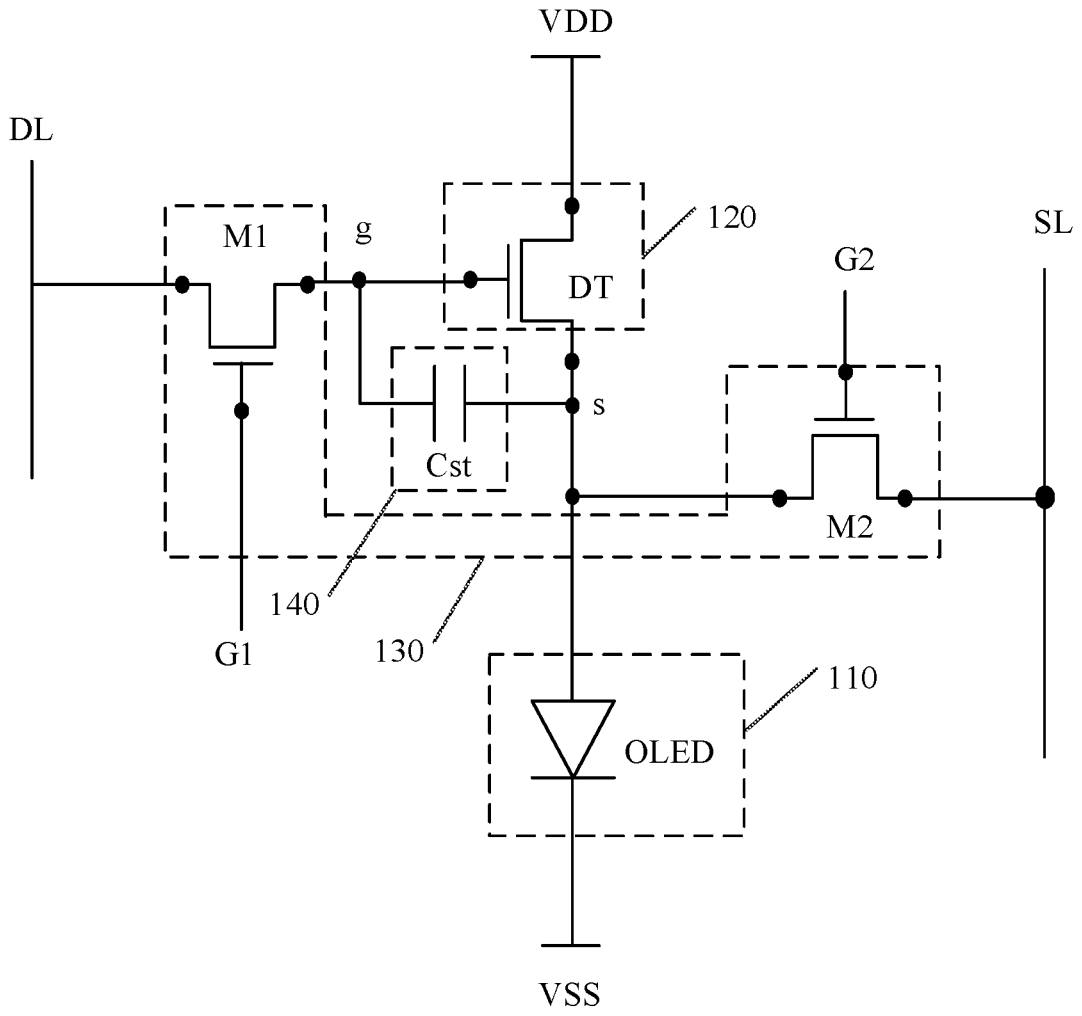
FIG. 1 is a schematic structure view of a pixel circuit provided in one or more exemplary embodiments.

Now, the claimed subject matter will be described with reference to the drawings, wherein same reference numbers are usually used for indicating same units throughout the description. In the following description, many specific details are set forth for illustrative purposes so as to provide understandings of the claimed subject matter. However, the claimed subject matter can be practiced without these specific details.

Unless otherwise defined, technical terms or scientific terms used in the embodiments of the present disclosure should have common meanings understood by one having ordinary skills in the art of the present disclosure. The wordings of "first", "second" or the like used in the exemplary embodiments do not indicate any sequence, number or importance, but instead, they are only intended for differentiating different components. The wordings of "comprise", "include" or the like mean that elements or objects preceding the wordings cover elements or objects listed after the wordings and equivalents thereof, and do not exclude other elements or objects. The wordings of "connect", "connection" or the like are not limited to physical or mechanical connection, but instead they may comprise electrical connections, whether directly or indirectly. The wordings of "up", "down", "left", "right" or the like are only intended for indicating relative position relations, and when the absolute positions of the described objects are varied, the relative position relations may also be varied correspondingly.

In related techniques, in order to keep homogeneity of light emission of a display device, it is necessary to compensate for a threshold voltage of a drive transistor comprised in a pixel circuit. Usually, during a period of an image frame, for the purpose of compensating for the threshold voltage, the operation of the pixel circuit comprises: a reset stage, a sense stage, a data-writing stage and a light emitting stage.

In the reset stage: by applying a reference voltage $V_{ref}$ to the gate of the drive transistor of the pixel circuit and a reset voltage $V_{reset}$ to the source of the drive transistor, a source voltage of the drive transistor is reset. Since the gate-source voltage of the drive transistor is now greater than a threshold voltage $V_{th}$ of the drive transistor, the drive transistor is switched on in this stage.

In the sense stage: by continuously applying a reference voltage to the gate of the drive transistor and meanwhile discharging the source, the source voltage is gradually elevated from the reset voltage to $V_{ref}-V_{th}$, and thus the drive transistor is gradually switched off. That is, the gate-source voltage $V_{gs}$ of the drive transistor is gradually changed from $V_{ref}$ to $V_{th}$. Since the source voltage of the drive transistor is now a function of the threshold voltage, it may be considered that sensing of the threshold voltage $V_{th}$ of the drive transistor is realized in this way.

In the data-writing stage: a pixel data voltage $V_{data}$ is written into the gate of the drive transistor (i.e., $V_g=V_{data}$). Since the gate-source voltage is now greater than the threshold voltage, the drive transistor is switched on. In the previous stage, the source voltage of the drive transistor has become $V_s=V_{ref}-V_{th}$ and the gate voltage is now $V_g=V_{data}$, so a drive current now flowing through the drive transistor may be calculated as: $I_{ds}=k(V_{gs}-V_{th})^2=k=(V_{data}-V_{ref})^2$, k being a conductive constant. As can be seen from the above formula, since the drive current $I_{ds}$ flowing through the drive transistor is irrelevant to the threshold voltage $V_{th}$, the compensation for the threshold voltage $V_{th}$ is achieved and the influence of variations in the threshold voltage $V_{th}$ on the actual driving is eliminated.

In the light emitting stage: the drive transistor is kept to be switched on so as to output a drive current to drive a light emitting unit to emit light.

In a next image frame, the pixel circuit repeats the same operation stages.

As can be seen from the above operation timing, in this compensation manner and for the drive transistor, it will be in an ON state during the light emitting stage of an image frame. This ON state will be kept until the reset stage of the next image frame. In this way, the drive transistor is kept switched on during a relatively long time period including the light emitting stage of an image frame and the reset stage of the next image frame. Due to the characteristic of the inherent hysteresis of a drive transistor, the long-lasting ON state of the drive transistor will cause inaccuracy of the threshold voltage $V_{th}$ sensed in the sense stage and then the threshold voltage $V_{th}$ cannot be compensated accurately, which results in inhomogeneity of the light emission of the product.

In a pixel circuit provided in the exemplary embodiments, an offset elimination stage is added at the beginning of an image frame $F_n$ and prior to the reset stage. The drive transistor is switched off in the offset elimination stage, which avoids the drawback of inaccurate compensation caused by the hysteresis characteristic of the drive transistor itself. Thereby, the threshold voltage of the drive transistor of the pixel circuit may be compensated accurately and the homogeneity of light emission of the display device may be improved.

FIG. 1 shows a schematic structure view of a pixel circuit according to one or more exemplary embodiments. As shown in FIG. 1, the pixel circuit comprises: a light emitting unit 110, a drive transistor 120 and a control circuit 130.

The light emitting unit 110 is used for displaying image frames by emitting light. The light emitting unit 110 may comprise an organic light emitting diode OLED 111, but is not limited thereto. For example, the light emitting unit 110 may also be a quantum dot light emitting diode, a micro-light emitting diode and so on. Exemplarily, an organic light emitting diode OLED is described in the following exemplary embodiments.

A first electrode of the drive transistor 120 may be connected to a first terminal of the light emitting unit 110 and the drive transistor 120 is configured to drive the light emitting unit 110 to emit light. The drive transistor 120 drives the light emitting unit 110 to emit light by providing a drive current to the light emitting unit 110. A second electrode of the drive transistor 120 may be connected to a first voltage terminal, e.g., VDD. In an example, the first electrode of the drive transistor 120 is a source, and the second electrode is a drain.

The control circuit 130 is connected to a gate and the first electrode of the drive transistor 120. The control circuit 130 is configured to control the drive transistor 120 according to signals on control lines. The controlling comprises, but is not limited to, resetting a source voltage of the drive transistor 120, sensing a gate-source voltage of the drive transistor 120, switching on and off the drive transistor 120, and controlling a drive current flowing through the drive transistor 120 and used for driving the light emitting unit and so on. The control circuit 130 may be configured for resetting, in a reset stage of an image frame, a voltage of the first electrode of the drive transistor by applying a reset voltage via the control line, and sensing, in a sense stage, a threshold voltage of the drive transistor by applying a reference voltage via the control line. The control circuit 130 is further configured to control, in an offset elimination stage arranged at the beginning of the image frame and prior to the reset stage, the drive transistor 120 to be switched off. The drive transistor 120 was in an ON state at the end of a previous image frame.

In some exemplary embodiments, the control line comprises a first gate line G1 and a second gate line G2. The first gate line and the second gate line are used for providing first and second gating signals to the pixel circuit. The gating signals may comprise an ON signal and an OFF signal. Additionally, the control line may further comprise a data line DL and a sense line SL. The data line may be used for providing a reference voltage $V_{ref}$ and a data voltage $V_{data}$ to the pixel circuit. The sense line may be used for providing a reset voltage $V_{reset}$ to the pixel circuit. Exemplarily, the reset voltage may be 0V.

In some exemplary embodiments, the control circuit 130 may comprise a first transistor M1 and a second transistor M2. A gate of the first transistor M1 is connected to the first gate line G1, a first electrode of the first transistor M1 is connected to the data line DL, and a second electrode of the first transistor M1 is connected to the gate of the drive transistor DT. The first transistor M1 is switched on and off under control of the first gating signal. A gate of the second transistor M2 is connected to the second gate line G2, a first electrode of the second transistor M2 is connected to the first electrode of the drive transistor DT, and a second electrode of the second transistor M2 is connected to the sense line SL. The second transistor M2 is switched on and off under control of the second gating signal.

The second electrode of the drive transistor DT is connected to a first voltage terminal VDD, and the first electrode of the drive transistor DT is connected to a first terminal of the organic light emitting diode OLED. A second terminal of the organic light emitting diode OLED is connected to a second voltage terminal VSS.

In one or more exemplary embodiments, the first transistor M1 is configured to be switched off under control of the first gate line G1 (i.e., the first gating signal) in the offset elimination stage. The second transistor M2 is configured to be switched on under control of the second gate line G2 (i.e., the second gating signal) in the offset elimination stage, such that the first electrode of the drive transistor DT conductively connects with the sense line SL and the voltage of the first electrode of the drive transistor DT is elevated by charging a parasitic capacitor of the sense line. The drive transistor DT is configured to be switched off in the offset elimination stage when the voltage of the first electrode (e.g., the source) is elevated to a level that makes the gate-source voltage of the drive transistor DT smaller than the threshold voltage.

In one or more exemplary embodiments, the first transistor M1 is further configured to be switched on under control of the first gate line G1 in the reset stage so as to output the reference voltage on the data line DL to the gate of the drive transistor DT. The second transistor M2 is further configured to be switched on under control of the second gate line G2 in the reset stage so as to output the reset voltage on the sense line SL to the first electrode of the drive transistor DT. A difference between the reference voltage and the reset voltage is arranged to be greater than the threshold voltage such that the drive transistor is switched on.

In one or more exemplary embodiments, the first transistor M1 is further configured to be switched on under control of the first gate line G1 in the sense stage so as to output the reference voltage to the gate of the drive transistor DT. The second transistor M2 is further configured to be switched off under control of the second gate line G2 in the sense stage so as to elevate the voltage of the first electrode (e.g., the source) of the drive transistor DT from the reset voltage. The drive transistor DT is configured to be switched off in the sense stage when the voltage of the first electrode of the drive transistor DT is elevated to a level that makes the gate-source voltage of the drive transistor DT smaller than the threshold voltage.

In some exemplary embodiments, the pixel circuit further comprises a tank circuit 140 for storing the data voltage of the data line. As shown in FIG. 1, the tank circuit 140 may comprise a storage capacitor Cst. A first terminal of the storage capacitor Cst is connected to the gate of the drive transistor DT. A second terminal of the storage capacitor Cst may be connected to the first electrode or the second electrode of the drive transistor DT. FIG. 1 schematically shows that the second terminal of the storage capacitor Cst is connected to the first electrode of the drive transistor DT.

The first transistor M1 may be configured to be switched on under control of the first gate line G1 in a data-writing stage subsequent to the sense stage so as to store the data voltage of the data line DL in the tank circuit 140.

The first transistor M1 may be further configured to be switched off under control of the first gate line G1 in a light emitting stage subsequent to the data-writing stage. The second transistor M2 is configured to be switched off under control of the second gate line G2 in the light emitting stage. The tank circuit 140 is configured for discharging the gate of the drive transistor DT in the light emitting stage to keep the drive transistor DT switched on, to drive the light emitting unit 110 to emit light.

It can be understood that, according to the exemplary embodiments of the present disclosure, the first transistor, the second transistor and the drive transistor may be either N-type transistors, or P-type transistors. The first electrode of each transistor may be a source and the second electrode may be a drain, or the first electrode of each transistor may be a drain and the second electrode may be a source.

It can be understood that although the pixel circuit is exemplarily illustrated as a structure of 3T1C (i.e., 3 transistors and 1 capacitor) in FIG. 1, the present disclosure is not limited thereto. Instead, it may adopt any other suitable structure.

A method for driving a pixel circuit according to the exemplary embodiments will be described with reference to FIG. 2 below. In the description hereinafter, exemplarily, the first electrode of the drive transistor is a source and the second electrode is a drain; the first voltage terminal VDD inputs a high level and the second voltage terminal VSS inputs a low level. Besides, the procedure of switching on and off the transistors is exemplified by taking all transistors as N-type transistors.

Figure 2:
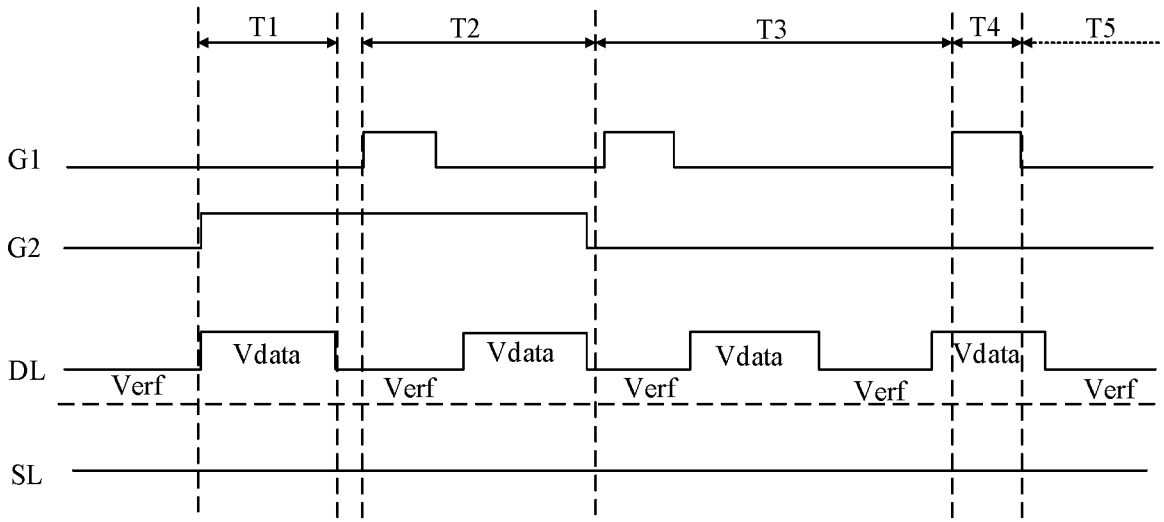
FIG. 2 is a schematic operation timing chart of a pixel circuit provided in one or more exemplary embodiments.

FIG. 2 shows an operation timing chart for driving a pixel circuit according to one or more embodiments of the present disclosure. According to the exemplary embodiments, in a period of an image frame, the operation of the pixel circuit comprises: an offset elimination stage T1 (which may also be called an on-bias stage), a reset stage T2, a sense stage T3, a data-writing stage T4 and a light emitting stage T5.

The offset elimination stage T1 may be arranged at the beginning of the image frame and prior to the reset stage T2. In the offset elimination stage T1, the drive transistor DT that was in an ON state at the end of a previous image frame $F_{n-1}$ may be controlled to be switched off, where n is a positive integer greater than or equal to 2. Optionally, for a first image frame F1, the offset elimination stage may either be arranged or not. For example, in some exemplary embodiments, prior to the first image frame F1, if the drive transistor DT is in an ON state, the offset elimination stage may be arranged for controlling the drive transistor DT to be switched off when proceeding to the first image frame F1.

In some exemplary embodiments, for the pixel circuit according to the exemplary embodiments of the present disclosure as shown in FIG. 1 for example, the offset elimination stage T1 may comprise the following operations: inputting an OFF signal (e.g., a low level signal) into the first gate line G1 to control the first transistor M1 to be switched off, and inputting an ON signal (e.g., a high level signal) into the second gate line G2 to control the second transistor M2 to be switched on. Accordingly, the drive transistor DT is gradually switched off from the ON state that it was in at the end of a previous image frame.

Figure 3:
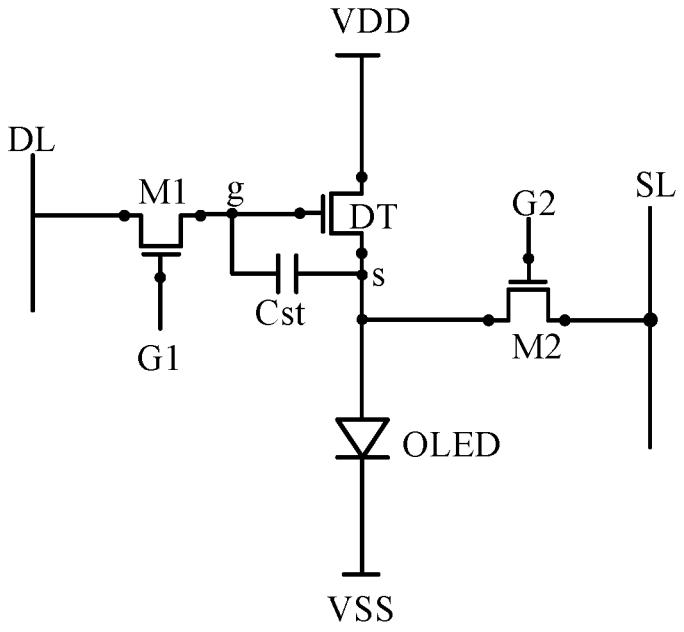
FIG. 3 is an equivalent circuit diagram of the pixel circuit of FIG. 1.

In order to describe the operation of the pixel circuit more clearly, an equivalent circuit diagram of FIG. 1 is shown in FIG. 3. In FIG. 3, Cvc is an equivalent capacitor of the parasitic capacitor of the sense line SL, Coled is an equivalent capacitor of the parasitic capacitor of the organic light emitting diode OLED.

In the offset elimination stage T1, the first gate line provides an OFF signal, so the first transistor M1 is switched off. Since the gate-source voltage $V_{gs}$ of the drive transistor in the previous image frame $V_{gs}$ is greater than the threshold voltage of the drive transistor, the drive transistor DT is still kept in an ON state at an initial instant of T1. As the second transistor M2 is switched on, the source (S) of the drive transistor DT charges the parasitic capacitor Cvc of the sense line SL such that a source potential V of the drive transistor DT$V_s$ gradually elevated to $V'_{data}-V_{th}$ (i.e., $V_s=V'_{data}-V_{th}$), where $V'_{data}$ is the pixel data voltage of the previous image frame. In this stage, since the gate voltage of the drive transistor DT is $V'_{data}$, the gate-source voltage $V_{gs}$ of the drive transistor DT will be smaller than the threshold voltage $V_{th}$ (i.e., $V_{gs}<V_{th}$) when the source potential of the drive transistor is elevated to $V'_{data}-V_{th}$. Thereby, in stage T1, the drive transistor DT is switched off.

The reset stage T2 may comprise: inputting an ON signal (e.g., a high level signal) into the first gate line G1 and a reference voltage $V_{ref}$ into the data line DL, so as to control the first transistor M1 to be switched on and output the reference voltage $V_{ref}$ to the gate of the drive transistor DT, i.e., the gate voltage $V_g$ of the drive transistor DT is as follows: $V_g=V_{ref}$.

Meanwhile, in the reset stage T2, input an ON signal (e.g., a high level signal) into the second gate line G2 and a reset voltage $V_{reset}$ (which may be 0V schematically) into the sense line SL, so as to control the second transistor M2 to be switched on and output the reset voltage $V_{reset}$ to the first electrode of the drive transistor DT. This may reset the source voltage $V_s$ of the drive transistor DT, e.g., the source voltage $V_s$ of the drive transistor DT is as follows: $V_s=0$. In T2, the gate-source voltage $V_{gs}$ ($=V_{ref}$) of the drive transistor DT is greater than the threshold voltage $V_{th}$, so the drive transistor DT is switched on.

The sense stage T3 may comprise: inputting an ON signal into the first gate line G1 and a reference voltage $V_{ref}$ into the data line DL, so as to control the first transistor M1 to be switched on and output the reference voltage $V_{ref}$ to the gate of the drive transistor DT, i.e., the gate voltage $V_g$ of the drive transistor DT is as follows: $V_g=V_{ref}$.

Meanwhile, in the sense stage T3, input an OFF signal into the second gate line G2 to control the second transistor M2 to be switched off, such that the source voltage $V_s$ of the drive transistor is gradually elevated from the reset voltage (e.g., 0V) of the reset stage T2 to $V_{ref}-V_{th}$, i.e., to a level that makes the gate-source voltage of the drive transistor smaller than the threshold voltage of the drive transistor. Accordingly, the drive transistor DT is gradually switched off from the ON state of the reset stage T2.

In the sense stage T3, the gate-source voltage $V_{gs}$ of the drive transistor DT is gradually changed from $V_{ref}$ of the reset stage T2 to $V_{th}$, which realizes the sensing of the threshold voltage $V_{th}$ of the drive transistor DT and ensures that in the subsequent data-writing stage T4, the threshold voltage $V_{th}$ may be compensated to eliminate the influence of the threshold voltage $V_{th}$ on the actual driving.

The data-writing stage T4 may comprise: inputting an ON signal into the first gate line G1 and a pixel data voltage $V_{data}$ into the data line DL so as to control the first transistor M1 to be switched on and store the pixel data voltage $V_{data}$ in a tank circuit, e.g., a storage capacitor Cst. Since the gate-source voltage of the drive transistor DT is now greater than the threshold voltage, the drive transistor DT is switched on.

In practice, the capacitance of the parasitic capacitor Coled of the light emitting diode OLED is generally far greater than that of the storage capacitor Cst, and they differ by at least one order of magnitude.

In the data-writing stage T4, the first transistor M1 is switched on to write the pixel data voltage $V_{data}$ into the gate of the drive transistor DT. The gate voltage of the drive transistor DT is as follows: $V_g=V_{data}$, and the source voltage $V_s$ is as follows: $V_s=V_{ref}-V_{th}$, such that the drive transistor DT is switched on in this stage. The first voltage terminal VDD charges the parasitic capacitor Coled of the light emitting diode OLED via the drive transistor DT, such that the source voltage $V_s$ of the drive transistor DT is slightly greater than $V_{ref}-V_{th}$ (i.e., $V_{gs}$ will be appropriately reduced). Assuming that the variation of $V_s$ is $\Delta Vs$, a certain capability of compensating the mobility shifts (which are generally positive shifts) of the drive transistor DT may be achieved by means of this variation.

However, since the capacitance of the parasitic capacitor Coled is far greater than that of the storage capacitor Cst, the variation in the source voltage $V_s$ of the drive transistor DT is relatively small when the first voltage terminal VDD charges the parasitic capacitor Coled of the light emitting diode OLED via the drive transistor DT. Generally, it may be considered that in this stage, $V_s$ is kept constant, i.e., $V_s=V_{ref}-V_{th}$.

Based on this, in the data-writing stage T4, the drive current flowing through the drive transistor DT is: $I_{ds}=k(V_{gs}-V_{th})^2=k(V_{data}-V_{ref})^2$, k being a conductive constant. At this point, a drive current $I_{ds}$ flowing through the drive transistor DT is irrelevant to the threshold voltage $V_{th}$, thereby achieving the compensation of the threshold voltage $V_{th}$.

The light emitting stage T5 may comprise: inputting an OFF signal into both the first gate line and the second gate line to control both the first transistor M1 and the second transistor M2 to be switched off. Now, the storage capacitor Cst continuously discharges the gate of the drive transistor DT to keep the drive transistor DT switched on and drives the light emitting diode OLED to emit light by providing the drive current to the light emitting diode.

For the next image frame, the same method process comprising 5 stages is executed.

It can be understood that the drive method according to the exemplary embodiments is not limited to be applied to a pixel circuit having a specific structure as shown in FIG. 1. In contrast, the drive method according to the exemplary embodiments may be adapted to any other pixel circuit having a problem of inaccurate threshold voltage compensation caused by hysteresis effect of the drive transistor.

According to the exemplary embodiments, the drive transistor DT is switched off in the offset elimination stage T1 at the beginning of an image frame. This avoids inaccuracy of the sensed threshold voltage $V_{th}$ caused by the hysteresis effect of the drive transistor DT, which was in an ON state in the light emitting stage T5 at the end of the previous image frame, and in turn avoids the drawback of inaccurate compensation in the above related techniques.

Figure 4:
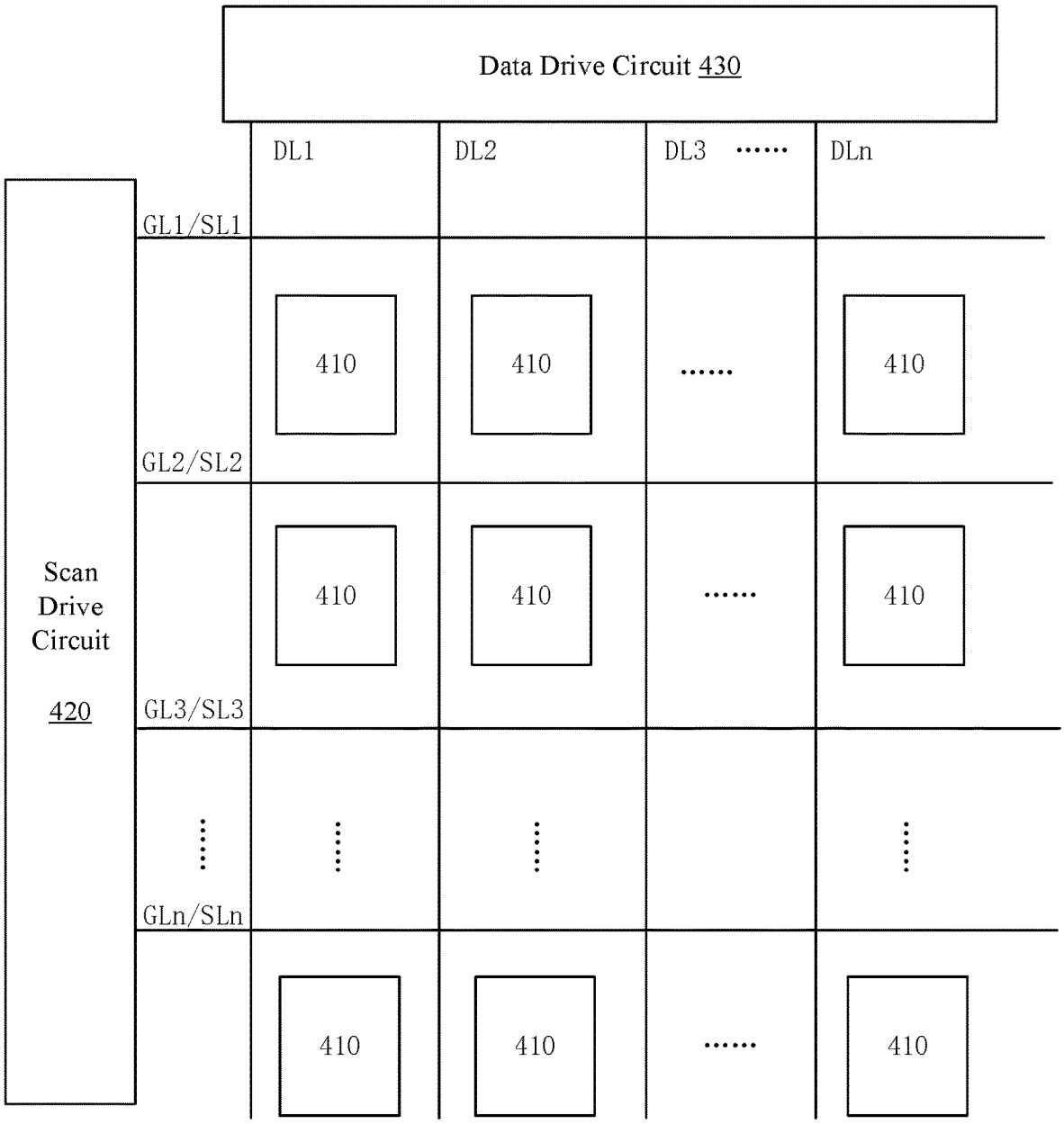
FIG. 4 is a schematic structure view of a display device provided in one or more exemplary embodiments.

FIG. 4 shows a display device according to one or more exemplary embodiments. As shown in FIG. 4, the display device comprises: a plurality of pixel units 410 distributed in an array and a plurality of control lines. The control lines comprise gate lines, data lines and sense lines. It should be noted that FIG. 4 only shows part of the pixel units 410 and the control lines, but the embodiments are not limited thereto. Each pixel unit 410 may comprise any pixel circuit provided according to the exemplary embodiments, e.g., the pixel circuit described above with reference to FIGS. 1-3.

As shown in FIG. 4, the display device may further comprise: a scan drive circuit 420 and a data drive circuit 430. The scan drive circuit 420 may be connected to a plurality of control lines to provide control signals to the pixel circuit 410. The control lines may comprise a plurality of gate lines (GL1, GL2, . . . GLn), to provide gating signals and other relevant control signals to the pixel circuit. The control lines may further comprise a plurality of sense lines (SL1, SL2, . . . SLn) to provide reset voltages to the pixel circuit. The data drive circuit 430 may be connected to a plurality of data lines, to provide reference voltages $V_{ref}$, pixel data voltages $V_{data}$ and other relevant control signals to the pixel circuit via the data lines (DL1, DL2, . . . DLn).

In some embodiments, the display device may further comprise other components, for example, a timing controller, a signal decoding circuit, a voltage conversion circuit and so on.

The display device provided in embodiment can be any product or component having a display function, such as electronic paper, a cellphone, a tablet computer, a television, a display, a notebook computer, a digital photo frame, a navigator or the like.

One having ordinary skills in the art may understand that, all or part of the steps for implementing the above method embodiments can be executed by hardware related to program instructions. The program instructions can be stored in a computer-readable storage medium and perform, when being executed, steps of the above method embodiments; and the above storage medium comprises: any medium capable of storing program codes, such as ROM, RAM, magnetic disc or optical disc.

The above description is only exemplary embodiments, but the protection scope of the present disclosure shall not be limited thereto. Any variation or substitution easily conceivable within the technical scope disclosed in the present disclosure for a skilled person who is familiar with this technical field shall fall within the protection scope of the present disclosure. Therefore, the protection scope of the present disclosure shall be subject to the protection scope of the claims.

The invention claimed is:

1. A pixel circuit, comprising:

a light emitting unit;

a drive transistor comprising a first electrode being connected to a first terminal of the light emitting unit, and configured to drive the light emitting unit to emit light so as to display an image frame; and a control circuit connected with a gate of the drive transistor and the first electrode of the drive transistor and configured to control the drive transistor according to signals of control lines, the controlling comprising: resetting, in a reset stage of the image frame, a voltage of the first electrode of the drive transistor by applying a reset voltage, and sensing, in a sense stage, a threshold voltage of the drive transistor by applying a reference voltage, the control circuit being further configured to control, in an offset elimination stage arranged at the beginning of the image frame and prior to the reset stage, the drive transistor to be switched off, which drive transistor was in an ON state at the end of a previous image frame;

wherein the drive transistor comprises a second electrode being connected to a first voltage terminal, a second terminal of the light emitting unit is connected to a second voltage terminal, and the control lines comprises a first gate line, a second gate line, a data line and a sense line, the control circuit further comprising;

a first transistor, comprising a gate being connected to the first gate line, a first electrode being connected to the data line, and a second electrode being connected to the gate of the drive transistor, and the first transistor being configured to be switched off under control of the first gate line in the offset elimination stage; and a second transistor, comprising a gate being connected to the second gate line, a first electrode being connected to the first electrode of the drive transistor, a second electrode being connected to the sense line, and the second transistor being configured to be switched on under control of the second gate line in the offset elimination stage such that the first electrode of the drive transistor conductively connects with the sense line and the voltage of the first electrode of the drive transistor is elevated by charging a parasitic capacitor of the sense line;

wherein the drive transistor is configured to be switched off in the offset elimination stage when the voltage of the first electrode of the drive transistor is elevated to a level that makes a gate-source voltage of the drive transistor smaller than a threshold voltage.

2. The pixel circuit according to claim 1, wherein the first transistor is further configured to be switched on under control of the first gate line in the reset stage to output the reference voltage on the data line to the gate of the drive transistor;

the second transistor is further configured to be switched on under control of the second gate line in the reset stage to output the reset voltage on the sense line to the first electrode of the drive transistor; and the reference voltage and the reset voltage are so set that the drive transistor is switched on.

3. The pixel circuit according to claim 1, wherein the first transistor is further configured to be switched on under control of the first gate line in the sense stage to output the reference voltage to the gate of the drive transistor;

the second transistor is further configured to be switched off under control of the second gate line in the sense stage to elevate the voltage of the first electrode of the drive transistor from the reset voltage; and the drive transistor is configured to be switched off in the sense stage when the voltage of the first electrode of the drive transistor is elevated to a level that makes the gate-source voltage of the drive transistor smaller than the threshold voltage.

4. The pixel circuit according to claim 1, further comprising: a tank circuit, comprising a first terminal being connected to the gate of the drive transistor, and a second terminal being connected to the first electrode of the drive transistor, wherein the first transistor is configured to be switched on under control of the first gate line in a data-writing stage subsequent to the sense stage so as to store the data voltage of the data line in the tank circuit.

5. The pixel circuit according to claim 4, wherein the first transistor is configured to be switched off under control of the first gate line in a light emitting stage subsequent to the data-writing stage, the second transistor is configured to be switched off under control of the second gate line in the light emitting stage, and the tank circuit is configured to discharge the gate of the drive transistor in the light emitting stage to keep the drive transistor switched on, so as to drive the light emitting unit to emit light.

6. The pixel circuit according to claim 1, wherein the light emitting unit is an organic light emitting diode.

7. The pixel circuit according to claim 2, wherein the first transistor is further configured to be switched on under control of the first gate line in the sense stage to output the reference voltage to the gate of the drive transistor;

the second transistor is further configured to be switched off under control of the second gate line in the sense stage to elevate the voltage of the first electrode of the drive transistor from the reset voltage; and the drive transistor is configured to be switched off in the sense stage when the voltage of the first electrode of the drive transistor is elevated to a level that makes the gate-source voltage of the drive transistor smaller than the threshold voltage.

8. A method for driving a pixel circuit according to claim 1, the method comprising:

resetting, in the reset stage, a voltage of the first electrode of the drive transistor by applying the reference voltage and the reset voltage, and sensing, in the sense stage, the threshold voltage of the drive transistor by applying the reference voltage, the method further comprising:

controlling, in an offset elimination stage that is arranged at the beginning of the image frame and prior to the reset stage, the drive transistor to be switched off, which drive transistor was in an ON state at the end of a previous image frame;

wherein in the pixel circuit, a second electrode of the drive transistor is connected to a first voltage terminal, a second terminal of the light emitting unit is connected to a second voltage terminal, and the control lines comprise a first gate line, a second gate line, a data line and a sense line, and the control circuit further comprises: a first transistor comprising a gate being connected to the first gate line, a first electrode being connected to the data line, and a second electrode being connected to the gate of the drive transistor; a second transistor comprising a gate being connected to the second gate line, a first electrode being connected to the first electrode of the drive transistor, and a second electrode being connected to the sense line; the drive transistor being configured to be switched off in the offset elimination stage when the voltage of the first electrode of the drive transistor is elevated to a level that makes a gate-source voltage of the drive transistor smaller than the threshold voltage, wherein in the offset elimination stage the method comprises:

inputting an OFF signal into the first gate line to control the first transistor to be switched off;

inputting an ON signal into the second gate line to control the second transistor to be switched on such that the first electrode of the drive transistor conductively connects with the sense line and the voltage of the first electrode of the drive transistor is elevated by charging a parasitic capacitor of the sense line.

9. The method according to claim 8, wherein in the reset stage the method comprises:

inputting an ON signal into the first gate line and a reference voltage into the data line to switch on the first transistor and output the reference voltage to the gate of the drive transistor;

inputting an ON signal into the second gate line and a reset voltage into the sense line to switch on the second transistor and output the reset voltage to the first electrode of the drive transistor;

in the sense stage the method comprises:

inputting an ON signal into the first gate line and a reference voltage into the data line to switch on the first transistor and output the reference voltage to the gate of the drive transistor;

inputting an OFF signal into the second gate line to switch off the second transistor, so as to elevate the voltage of the first electrode of the drive transistor from the reset voltage, and the drive transistor being switched off when the voltage of the first electrode of the drive transistor is elevated to a level that makes the gate-source voltage of the drive transistor smaller than the threshold voltage.

10. The method according to claim 8, wherein the pixel circuit comprises a tank circuit comprising a first terminal being connected to the gate of the drive transistor and a second terminal being connected to the first electrode of the drive transistor, and after the sense stage, the method further comprises:

in the data-writing stage, inputting an ON signal into the first gate line and a data voltage into the data line to switch on the first transistor and store the data voltage in the tank circuit;

in the light emitting stage, inputting an OFF signal into the first gate line and the second gate line and continuously discharging the gate of the drive transistor by the tank circuit to keep the drive transistor switched on, so as to drive the light emitting unit to emit light.

11. A display device comprising the pixel circuit according to claim 1.

12. The display device according to claim 11, wherein the first transistor is further configured to be switched on under control of the first gate line in the reset stage so as to output the reference voltage on the data line to the gate of the drive transistor;

the second transistor is further configured to be switched on under control of the second gate line in the reset stage so as to output the reset voltage on the sense line to the first electrode of the drive transistor;

the reference voltage and the reset voltage are so set that the drive transistor is switched on.

13. The display device according to claim 11, wherein the first transistor is further configured to be switched on under control of the first gate line in the sense stage to output the reference voltage to the gate of the drive transistor;

the second transistor is further configured to be switched off under control of the second gate line in the sense stage to elevate the voltage of the first electrode of the drive transistor from the reset voltage;

the drive transistor is configured to be switched off in the sense stage when the voltage of the first electrode of the drive transistor is elevated to a level that makes the gate-source voltage of the drive transistor smaller than the threshold voltage.

14. The display device according to claim 11, further comprising: a tank circuit comprising a first terminal being connected to the gate of the drive transistor, and a second terminal being connected to the first electrode of the drive transistor, wherein the first transistor is configured to be switched on under control of the first gate line in a data-writing stage subsequent to the sense stage so as to store the data voltage of the data line in the tank circuit.

15. The display device according to claim 14, wherein the first transistor is configured to be switched off under control of the first gate line in a light emitting stage subsequent to the data-writing stage, the second transistor is configured to be switched off under control of the second gate line in the light emitting stage, and the tank circuit is configured to discharge the gate of the drive transistor in the light emitting stage to keep the drive transistor switched on, so as to drive the light emitting unit to emit light.

16. The display device according to claim 11, wherein the light emitting unit is an organic light emitting diode.

17. The display device according to claim 12, wherein the first transistor is further configured to be switched on under control of the first gate line in the sense stage to output the reference voltage to the gate of the drive transistor;

the second transistor is further configured to be switched off under control of the second gate line in the sense stage to elevate the voltage of the first electrode of the drive transistor from the reset voltage;

the drive transistor is configured to be switched off in the sense stage when the voltage of the first electrode of the drive transistor is elevated to a level that makes the gate-source voltage of the drive transistor smaller than the threshold voltage.

* * * * *